US007556324B2

(12) United States Patent
Benz

(10) Patent No.: US 7,556,324 B2
(45) Date of Patent: Jul. 7, 2009

(54) REFRIGERATOR WITH A DOOR-OPENING AID

(75) Inventor: Thomas Benz, Neu-Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 140 days.

(21) Appl. No.: 11/023,948

(22) Filed: Dec. 28, 2004

(65) Prior Publication Data

US 2006/0021284 A1 Feb. 2, 2006

Related U.S. Application Data

(63) Continuation of application No. PCT/EP03/07344, filed on Jul. 8, 2003.

(30) Foreign Application Priority Data

Jul. 8, 2002 (DE) ..... 102 30 707

(51) Int. Cl.
*A47B 96/04* (2006.01)

(52) U.S. Cl. ..... 312/405; 49/277; 16/412; 296/146.9; 277/646; 277/921

(58) Field of Classification Search ..... 312/296, 312/405, 325, 326, 327, 328, 329; 49/276, 49/277, 278, 477.1, 316, 321, 320; 16/412; 296/146.9, 212; 292/DIG. 72; 277/645, 277/646, 630, 921

See application file for complete search history.

(56) References Cited

U.S. PATENT DOCUMENTS

| | | | | | |
|---|---|---|---|---|---|
| 2,527,084 | A | * | 10/1950 | Smith | 220/232 |
| 4,371,175 | A | * | 2/1983 | Van Dyk, Jr. | 174/357 |
| 4,884,415 | A | * | 12/1989 | Mandel et al. | 62/277 |
| 5,033,961 | A | * | 7/1991 | Kandler et al. | 433/89 |
| 5,181,341 | A | * | 1/1993 | Keys et al. | 49/477.1 |
| 5,425,164 | A | * | 6/1995 | El Dessouky | 29/243.524 |
| 5,702,168 | A | * | 12/1997 | Shin | 312/405 |
| 5,931,146 | A | * | 8/1999 | Schrader et al. | 124/23.1 |
| 6,138,432 | A | * | 10/2000 | Banicevic | 52/84.15 |
| 6,210,255 | B1 | * | 4/2001 | Zuniga et al. | 451/41 |
| 6,375,291 | B1 | * | 4/2002 | Nam et al. | 312/405 |
| 2003/0021637 | A1 | * | 1/2003 | Yang et al. | 405/239 |

FOREIGN PATENT DOCUMENTS

| | | | |
|---|---|---|---|
| EP | 230887 | * | 8/1987 |
| EP | 0 891 524 B1 | | 1/1999 |
| FR | 2 573 521 A1 | | 5/1986 |
| GB | 2 305 455 A | | 4/1997 |
| WO | 97/38273 | | 10/1997 |

* cited by examiner

*Primary Examiner*—José V Chen
*Assistant Examiner*—Matthew W. Ing
(74) *Attorney, Agent, or Firm*—James E. Howard

(57) ABSTRACT

A refrigerator including a door that is fastened to the heat-insulating housing thereof and a swell chamber as a door-opening aid. The chamber can be impinged upon by a pressure medium and is disposed between the rear side of the door and a face of the housing. A reservoir feeding the swell chamber with a pressure fluid is disposed on a face of the door and can be compressed by pulling a door handle.

11 Claims, 3 Drawing Sheets

Fig. 1
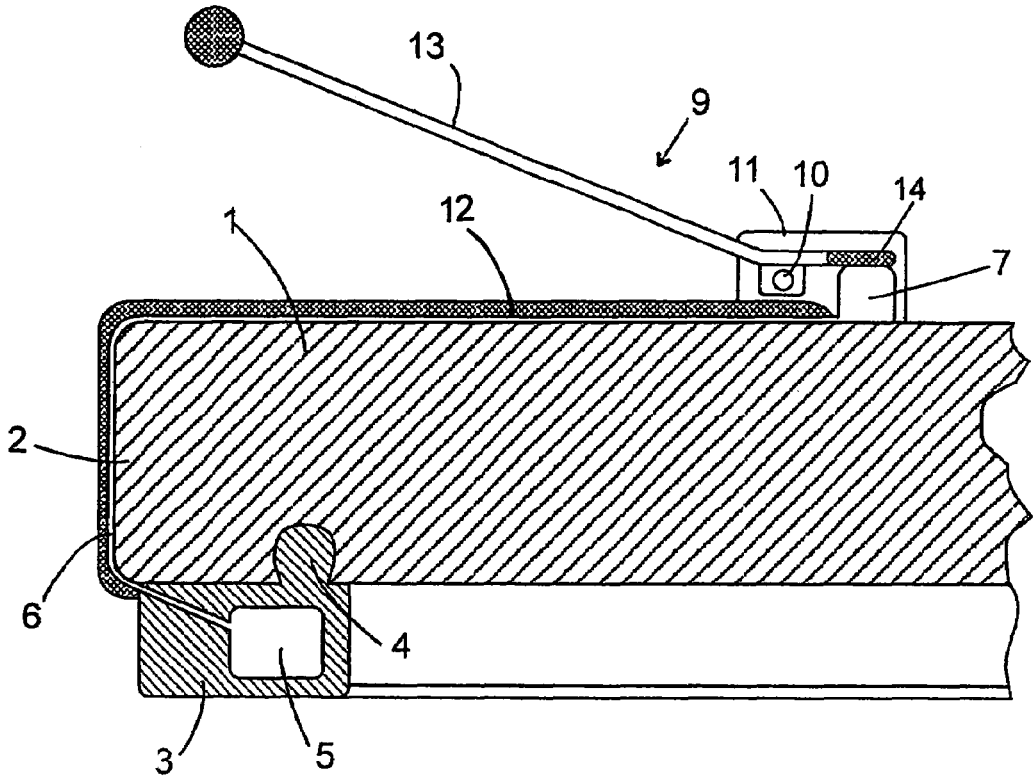
Fig. 2A
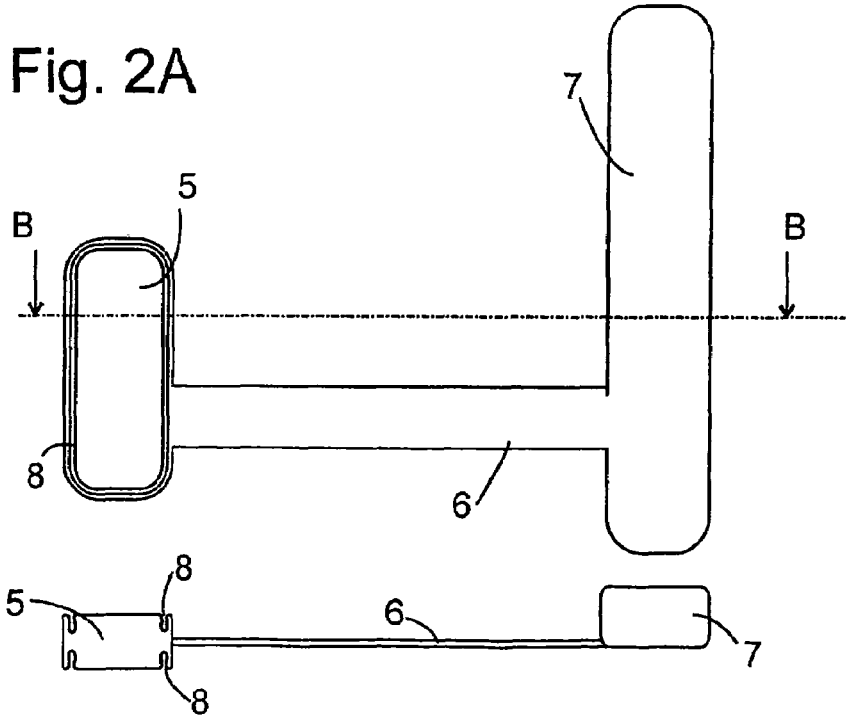
Fig. 2B

REFRIGERATOR WITH A DOOR-OPENING AID

CROSS-REFERENCE TO RELATED APPLICATION

This is a continuing application, under 35 U.S.C. § 120, of copending international application No. PCT/EP2003/007344, filed Jul. 8, 2003, which designated the United States; this application also claims the priority, under 35 U.S.C. § 119, of German patent application No. 102 30 707.5, filed Jul. 8, 2002; the prior applications are herewith incorporated by reference in their entirety.

BACKGROUND OF THE INVENTION

1. Field of the Invention

The present invention relates to a refrigerator having a heat-insulating housing and a door mounted on the housing, the door being provided with a door-opening aid.

It has become common practice in the case of refrigerators, in particular, in the case of refrigerators provided with large-surface-area doors, to provide the doors with door-opening aids to make them easier to open. Such door-opening aids operate by converting a tensile force to which the door is subjected by the user into a displacement force that acts between the rear side of the door and the front side of the housing.

Such a refrigerator with the door-opening aid is disclosed, for example, in European Patent 0 891 524 B1.

This prior art door-opening aid is formed by a two-armed lever that is articulated on a side flank of the door, a first longer arm of the lever serving as the door handle and a second shorter arm being pressed against the front side of the housing when the door handle is pulled, and, thus, displacing the door away from the housing.

One problem with this known door-opening aid is that, for precise guidance of the pivoting movement of the door handle, it is necessary to provide guide rails that have to be installed on the lateral flank of the door of the refrigerator, projecting away from this flank, between the flank and the door handle. Such a configuration results in the door handle projecting laterally to a considerable extent beyond the door. If the door handle also projects laterally beyond the housing of the refrigerator, this gives rise to problems with setting the refrigerator up in the immediate vicinity of kitchen units or other appliances. In particular, it is not possible for two refrigerators that are disclosed in European Patent 0 891 524 B1 to be set up directly one beside the other.

The problem of lateral projection could easily be solved if a force-transmitting element could be guided through a bore in the door. This is not practicable, however, because such a bore would interrupt the continuity of the door leaf and would create a heat bridge. The production outlay would also be considerable. This can only be avoided if the force exerted by the user is directed laterally around the door, as is the case in European Patent 0 891 524.

Although it should be possible, in the case of a known refrigerator, to avoid the lateral projection of the door handle by the making the door narrower, while maintaining the same outer dimensions of the housing, such a measure also decreases the surface area on the front side of the appliance housing that can be covered by the door and, thus, the useful volume that the refrigerator can have.

Another possibility would, indeed, be to provide the lateral flank of the door with a niche and to fit the door handle in this niche, but such a configuration would result in a considerable increase in the outlay for producing the door and, thus, in rising costs.

SUMMARY OF THE INVENTION

It is accordingly an object of the invention to provide a refrigerator with a door-opening aid that overcomes the hereinafore-mentioned disadvantages of the heretofore-known devices of this general type and that in which the door-opening aid has a novel functioning principle and that allows a force to which the front side of the door is subjected by the user to be transmitted to the rear side of the door with minimal lateral projection of the force-transmitting elements.

With the foregoing and other objects in view, there is provided, in accordance with the invention, a refrigerator, including a heat-insulating housing having a front side, a door mounted on the housing, the door having a rear side, and at least one swelling element to be subjected to action of a pressure medium disposed between the rear side of the door and the front side of the housing.

In accordance with another feature of the invention, the door has a door-mounting side and other sides and the swelling element is provided outside the door-mounting side on one of the other sides of the door.

In accordance with a further feature of the invention, the swelling element occupies a longitudinal portion of the one of the other sides.

The swelling element of such a refrigerator may be constructed as a cylinder/piston configuration. It is particularly straightforward and inexpensive, and sufficient for the small amount of displacement required, however, if the swelling element is constructed as a bag or pad with flexible walls, the thickness of this bag or pad varying depending on the quantity of pressure medium located in the swelling element. The swelling element expediently communicates with a compressible reservoir for the pressure medium. It is, thus, possible to provide a closed system in which the pressure medium, when the door-opening aid is used, is displaced out of the reservoir into the swelling element and, following this, returns into the reservoir. By virtue of the seal being lifted off with the aid of the swelling element, it is also the case, namely, in the region of the swelling element, at the same time, that not just the negative pressure that may be present is overcome, but also the force of attraction acting on the housing from the magnet of the magnetic door seal is overcome. The partial lifting off of the magnetic seal, then, gives rise, during the subsequent opening of the door, to a kind of "peeling-off effect" of the magnetic seal from the housing. As a result, the force for opening the door is further reduced.

In accordance with an added feature of the invention, the swelling element occupies a part of a longitudinal portion of the other sides of the door.

In accordance with an additional feature of the invention, there is provided a door handle secured on the door and having a height region and the part of the longitudinal portion is disposed within the height region.

In accordance with yet another feature of the invention, the swelling element has at least one flexible wall interacting with the front side of the housing.

Whereas the swelling element is fitted between the front side of the housing and the rear side of the door, it is possible for the reservoir to be fitted on the front side of the door and to communicate therewith through a channel that extends over the surface of a housing panel of the door, also over the lateral flank of the door. It is possible for the extent of the channel in the width direction of the door, level with the lateral flank, to be very small, that is to say, the lateral projection of the channel beyond the housing can also be avoided when the width of the door is only insignificantly smaller than that of the housing.

For protecting the channel, the channel expediently is covered over by a plate, e.g., made of a strong plastic or, preferably, metal.

To subject the reservoir to pressure, a door handle is expediently configured as a lever that can be pivoted about an axis and has a handgrip and a portion acting on the reservoir. In such a case, the handgrip and the portion acting on the reservoir are located, preferably, opposite one another on different sides of the axis. As a result, it is possible, by pulling the handgrip away from the door, to compress the reservoir between the portion of the door handle and the front side of the door.

Preferably, the axis is vertical because, in the case where a user does not have his/her hands free, such a configuration makes it easier for him/her to actuate the door handle using a shoulder or elbow.

This process of actuation is facilitated additionally if the handgrip is further remote from the mounting side of the door than the axis of the lever.

It is known per se to fit a sealing profile, generally in the form of a magnetic profile, between the rear side of the door and the front side of the housing of a refrigerator. A cavity of such an encircling flexible sealing profile may serve, according to the invention, for accommodating the swelling element.

In order to facilitate the opening displacement, it is possible, in the case of a magnetic profile, for the swelling element expediently to be disposed on the inside of the magnetic strip.

With the objects of the invention in view, there is also provided a refrigerator, including a heat-insulating housing having a front side, a door having a rear side and a door-mounting side, the door being mounted on the housing at the door-mounting side, a door handle pivotably secured on the door, a compressible reservoir storing a pressure medium, the door handle having a portion compressing at least a part of the reservoir when the handle is actuated, and at least one swelling element subjected to action of the pressure medium, the swelling element being fluidically connected to the reservoir, being disposed between the rear side of the door and the front side of the housing, and having at least one flexible wall interacting with the front side of the housing.

Other features that are considered as characteristic for the invention are set forth in the appended claims.

Although the invention is illustrated and described herein as embodied in a refrigerator with a door-opening aid, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 1 is a fragmentary, cross-sectional view of a section of a door of a refrigerator with a door-opening aid according to the invention;

FIG. 2A is a diagrammatic elevational view of part of the door of FIG. 1 and of a housing of a refrigerator according to the invention;

FIG. 2B is a diagrammatic cross-sectional view of the door part of FIG. 2A along section line B-B in FIG. 2A;

DESCRIPTION OF THE PREFERRED EMBODIMENTS

Figure 3:
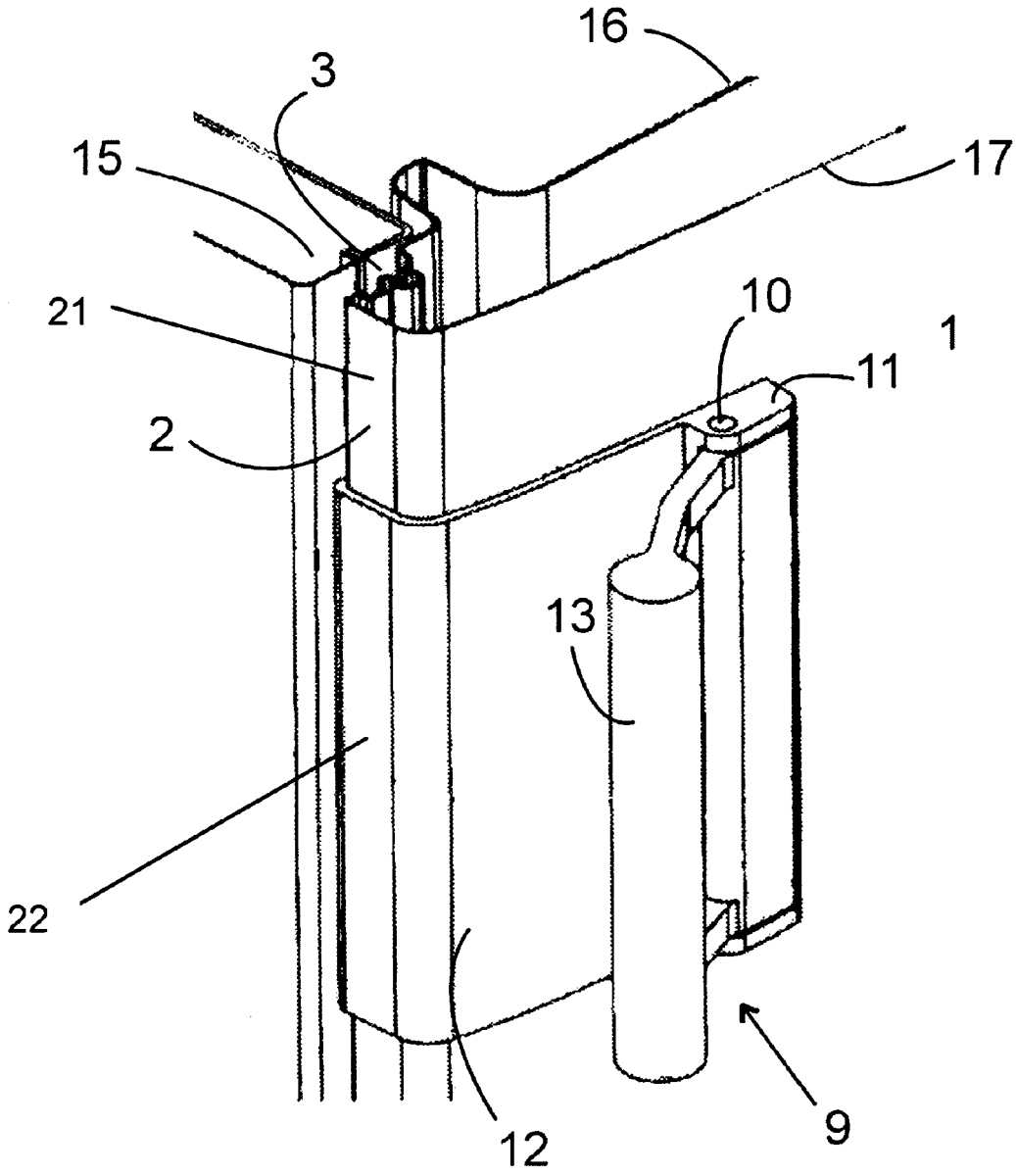
FIG. 3 is a fragmentary, perspective view of a reservoir and a swelling element of the door-opening aid of FIG. 1, separately from the door.

Referring now to the figures of the drawings in detail and first, particularly to FIG. 1 thereof, there is shown a simplified section through part of a door of a refrigerator provided with a door-opening aid according to the present invention. The door 1 is mounted, on a side that is directed away from its lateral flank 2 shown in FIG. 1, on a non-illustrated refrigerator housing. A flexible sealing profile 3 is fastened on the rear side of the door 1, the rear side being directed away from the housing, by virtue of an extension 4 of the sealing profile 3 being inserted into a groove that runs around the entire rear side of the door 1 in the vicinity of the periphery.

The door 1 is constructed in a manner that is known per se, and is, thus, not illustrated in more detail in FIG. 1, from an outer cladding, e.g., made of metal, an inner cladding, e.g., made of plastic, which is directed toward the housing and is adjacent to the outer cladding in the vicinity of the groove, and a heat-insulation material, which fills a cavity formed between the outer housing panel and the inner wall.

The cross-section of FIG. 1 shows, in the interior of the sealing profile 3, a swelling element 5 that extends over a few centimeters in the vertical direction, perpendicular to the sectional plane of FIG. 1, along the longitudinal plane located opposite the mounting side of the door 1. The overall height of the swelling element 5, thus, only occupies a small portion of the length of the door 1. The swelling element 5 is connected, through a channel 6, to a reservoir 7 provided on the front side of the door 1. The channel 6 runs along a part or front side of the door 1 and over the lateral flank 2, beneath a plate 12 made of a strong, tough plastic or of a metal, e.g., aluminum, which protects the channel 6 against damage.

FIG. 2A is a side view of the swelling element 5, the channel 6, and the reservoir 7, shown separate from the door 1 on which these are installed. The swelling element 5, channel 6, and reservoir 7 are connected integrally to one another throughout; they are of a plastic material that is flexible, but does not expand to any significant extent. They may be produced, for example, by virtue of two blanks with the outline shown in FIG. 2A being created from flat plastic material and welded along their peripheries, a final welding step for definitive sealing purposes being carried out only following introduction of a pressure fluid, e.g., a brine or a water/alcohol mixture.

FIG. 2B shows a section through the swelling element 5, the channel 6, and the reservoir 7 along a section line B-B in FIG. 2A. The channel 6 has a markedly elongate cross-section in the vertical direction. This is necessary in order, on one hand, to have a cross-sectional surface area of the channel 6 that is sufficient for the quick exchange of pressure fluid between the reservoir 7 and swelling element 5 and, on the other hand, to minimize the lateral projection of the channel 6 beyond the flank 2. A second function of the plate 12, in addition to its protective function, is, thus, to prevent the cross-section of the channel 6 from spreading when its internal pressure increases as a result of compression of the reservoir 7 and, thus, to ensure that pressure fluid forced out of the reservoir 7 reaches the swelling element 5.

It is possible to see passages 8 that run around the top side and underside of the swelling element 5 and promote an increase in size of the swelling element 5 in the vertical direction of FIG. 2B when the reservoir 7 is subjected to pressure and pressure fluid flows from there into the swelling element 5. Such an increase in size of the swelling element causes the sealing profile 3 to become thicker in the vertical direction of FIG. 1, that is to say, causes the door and housing of the refrigerator to be displaced away from one another over a portion of the sealing profile 3 that corresponds to the vertical extent of the swelling element 5. By virtue of the sealing profile 3 becoming locally thicker in this way, it is displaced away from the housing of the refrigerator in the region adjacent to the swelling element 5. The sealing profile 3, thus, no longer provides a sealing function, a negative pressure that may prevail in the interior of the appliance is eliminated, and the door 1 can be easily opened.

To compress the reservoir 7, a door handle 9 is articulated on the front side of the door 1 such that it can be pivoted about a vertical axis 10. As can clearly be seen in FIG. 3, in particular, the axis 10 is defined by bores in two lugs 11 that project forward from the plate 12, which covers over the channel 6. The door handle 9 is configured as a two-armed lever—a first lever arm, which projects obliquely forward from the axis 10, forming a hand grip 13 and the second lever arm 14 keeping the reservoir 7 pressed against the outer wall of the door 1. By pulling the hand grip 13 forward (upward as viewed in FIG. 1), a user subjects the reservoir 7 to pressure. As a result, the door 1 is displaced away from the housing of the refrigerator by pressure fluid flowing from the reservoir 7 into the swelling element 5. It is contemplated that swelling element 5 may be located anywhere along a longitudinal portion 21 of door 1.

The plate 12 and the door handle 9 are symmetrical in relation to a horizontal plane. The plate 12 may include a height region 22 mounted along a part of longitudinal portion 21 of door 1. By virtue of the peripheries of the plate 12 being adhesively bonded to the door 1, the door handle can be installed both on the right-hand side and on the left-hand side of the door 1. As a result, the user can decide as to whether the door 1 is mounted on the left or right of the housing.

Figure 4:
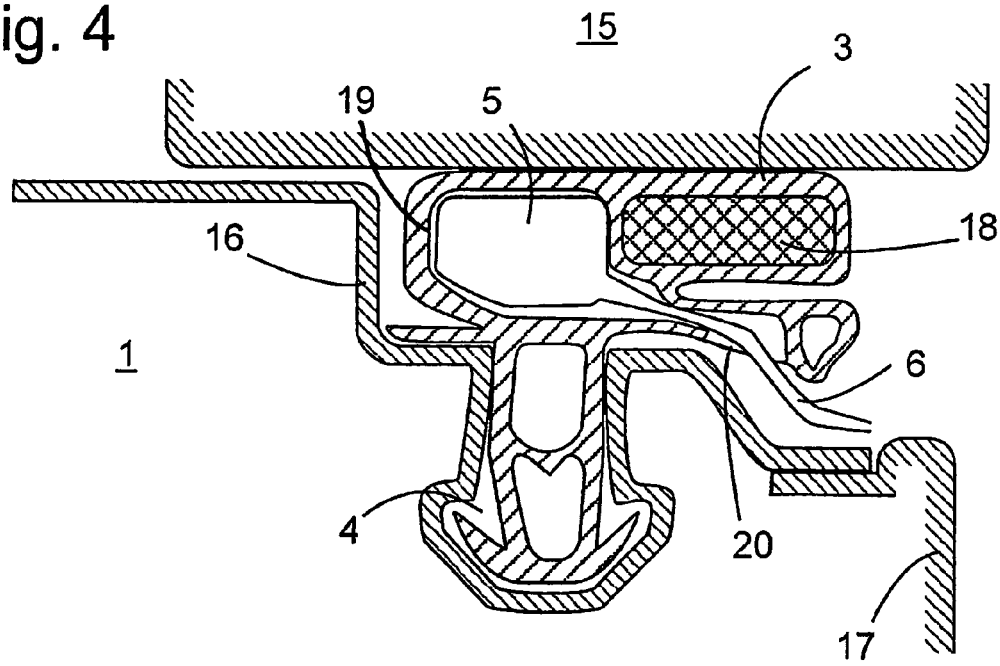
FIG. 4 is a fragmentary, cross-sectional view through a sealing profile, a magnetic profile, and adjacent parts of the door according to the invention and of the housing of a refrigerator in a closed state of the door.

FIG. 4 shows a section through mutually opposite regions of the door 1 and of a side wall 15 of the refrigerator housing according to a preferred configuration of the invention. The abovementioned groove of the door 1 is formed in a plastic inner cladding 16 that forms the inside of the door 1; this inner cladding 16 is connected to an outer cladding, for example, by the foaming expansion of a heat-insulation material that is introduced in liquid starting components between the inner and the outer claddings.

The sealing profile 3 has an encircling chamber 18 that is filled with magnetic material. As a result, the door 1 is kept closed by magnetic forces acting between this material and metal of the side wall 15.

The chamber 18 extends only over part of the width of the sealing profile 3; located parallel to it, in the direction of the interior of the refrigerator, is a second chamber 19, in which the swelling element 5 is accommodated. The chamber 19 opens out into the surroundings through a slot 20, through which the channel 6 extends. Rather than running over the entire length of the sealing profile 3, the slot 20 expediently runs, in a height provided for fitting the door handle, merely over a length that is sufficient to introduce the swelling element 5 into the chamber 19. The swelling element 5, which is associated with the location where the door handle 9 is fitted, is either of the same height as this door handle 9 or of a height that is smaller than the height of the door handle 9.

Figure 5:
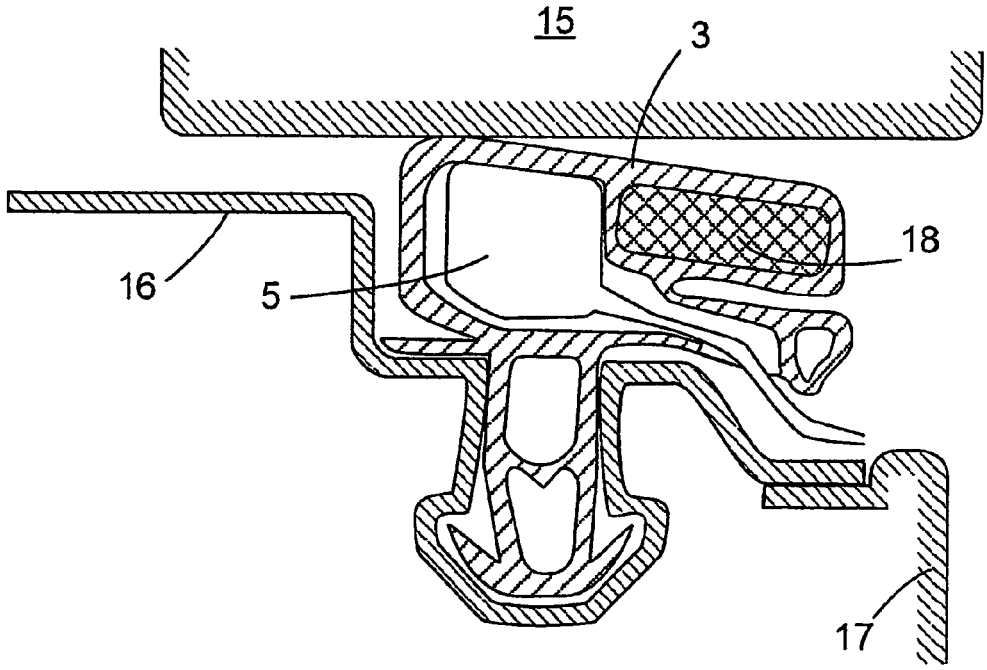
FIG. 5 a fragmentary, cross-sectional view through the parts of FIG. 4 in a displaced state.

FIG. 5 shows the same section as for FIG. 4, albeit with the swelling element 5 in an expanded state. The chamber 18 with the magnetic material has been lifted from the front side of the side wall 16. As a result, magnetic forces acting between the material and the side wall are reduced to a considerable extent. It is also the case, above and beneath the swelling element 5, that the sealed abutment of the profile 3 against the side wall 15 has been eliminated. Thus, the door can be readily opened in this state.

Because the channel 6, which connects the swelling element 5 to the reservoir 7, and the plate 12, which covers the channel 6 over, can be kept very flat, the above-described door-opening aid only requires minimal lateral projection beyond the door 1 and, thus, does not obstruct a number of refrigerators from being set up directly adjacent to one another or a refrigerator from being set up in direct lateral contact with other units.

In contrast to the exemplary embodiment described, provision may be made for the swelling element 5 to be disposed not on the side of the door 1 that is located opposite the door-mounting side but on one of the other door sides. Moreover, provision may also be made for the swelling element 5 to be provided outside the door-mounting side at a number of locations of the other door sides or else, for example, for one swelling element to be provided on each of the other door sides.

I claim:

1. A refrigerator, comprising:

a heat-insulating housing having a front side and an access opening formed on the front side;

a door mounted on the housing, the door having a front side and a rear side located opposite its front side, the door being movable between a closed position in which the door is in a covering disposition relative to the access opening of the housing and an open position in which the door is spaced away from the access opening of the housing such that access can be had through the access opening of the housing;

a sealing profile, the sealing profile performing a sealing function in which it creates a seal between the housing and the door, the sealing profile being mounted on the rear side of the door and the sealing profile having a dislodgable location that is in contact with the front side of the heat-insulating housing;

a swelling assembly including a push away location and a flexible swelling element retaining therein a fluid, the push away location of the swelling assembly being spaced from the dislodgable location of the sealing profile, the flexing swelling element being mounted on the rear side of the door and having a dimension that changes as a function of a change in a distribution of the retained fluid and the swelling assembly being disposable between a stand by disposition in which the swelling assembly does not diminish the sealing function of the sealing profile and a seal breaking disposition in which the dimensional property of the fluid retainer has changed such that the flexible swelling element expands and causes the push away location of the swelling assembly to exert a force in one direction against the front side of the heat-insulating housing and causes the swelling assembly to exert a force in an opposite direction against the door, the oppositely directed forces exerted by the swelling assembly resulting in an increase in a spacing between the door and the dislodgable location of the sealing profile such that the sealing function of the sealing profile at the dislodgable location is diminished; and a reservoir provided on the front side of the door, the reservoir being connected to the flexible swelling element and operating in response to an opening input that indicates that the status of the door is to be changed from its closed position into its open position, the reservoir operating, in response to such an opening input, to effect a change in the distribution of the flexible swelling element in the flexible swelling element such that the fluid retainer expands and causes the swelling assembly to change from its stand by disposition into its seal breaking disposition and the operation of the reservoir and the swelling assembly being configured such that, in connection with an opening of the door, the sealing function of the sealing profile at its dislodgable location is initially diminished by the action of the one force exerted by the push away location of the swelling assembly on the heat-insulating housing and by the opposite force exerted by the swelling assembly on the door as the swelling assembly changes from its stand by disposition into its seal breaking disposition.

2. The refrigerator according to claim 1 and further comprising a hand grip on the door for a user to engage the door with a hand to exert a door opening force on the door and the reservoir and the hand grip being operatively connected such that an engagement of the hand grip by a user operates as an opening input to which the reservoir is responsive.

3. The refrigerator according to claim 1, wherein the reservoir connected to the flexing swelling element for the flow of fluid between the reservoir and the flexing swelling element, the dimension of the flexible swelling element as a function of the volume of flexible swelling element in the fluid retainer, and the fluid flows between the reservoir and the flexing swelling element in response to the reservoir responding to an opening input.

4. The refrigerator according to claim 1, wherein the swelling assembly automatically returns to its stand by disposition in connection with a change in the status of the door from its open position into its closed position.

5. The refrigerator according to claim 1, wherein the dislodgable location of the sealing profile has a planar surface that is disposed against a planar surface of the front side of the heat-insulating housing when the sealing profile performs its sealing function and the planar surface of the dislodgable location of the sealing profile remains in its planar form throughout a movement of the swelling assembly between its stand by disposition and its seal breaking disposition.

6. The refrigerator according to claim 1, wherein the sealing profile is formed as an encircling flexible sealing profile fitted between the rear side of the door and the front side of the housing and having a cavity and the swelling element is disposed in the cavity.

7. The refrigerator according to claim 6, wherein the sealing profile includes a magnetic strip at least at the dislodgable location of the sealing profile and the magnetic strip magnetically interacts with the front side of the housing such that the dislodgable location of the sealing profile is retained by the magnetic interaction against the front side of the housing.

8. The refrigerator according to claim 6, wherein the sealing profile extends adjacent an edge of the door and the swelling element is located inwardly of the dislodgable location of the sealing profile in a direction from the edge of the door toward an opposite edge of the door.

9. The refrigerator according to claim 2, wherein the hand grip is formed by a door handle that is movably secured to the door, the door being movable from its closed position to its open position when a user applies a force on the door handle and the door handle initially moving along an initial movement path when a user first applies a force on the door handle with this initial movement path being a path of movement of the door handle relative to the door, the reservoir includes a compressible reservoir communicated with the flexible swelling element for the passage of fluid between the compressible reservoir and the flexible swelling element, and the door handle is disposed relative to the compressible reservoir for effecting a compression of the compressible reservoir such that movement of the door handle along the initial movement path causes compression of the compressible reservoir, whereupon fluid is driven from the compressible reservoir into the flexible swelling element and the volume of fluid retained in the flexible swelling element thereby increases.

10. The refrigerator according to claim 9, wherein the compressible reservoir and the door handle are located on the front side of the door and the flexible swelling element is located on the rear side of the door.

11. The refrigerator according to claim 1, wherein the flexible swelling element expands from a stand by volume when the swelling assembly is in its stand by disposition into a completed expansion volume when the swelling assembly is in its seal breaking disposition, the dislodgable location of the sealing profile includes a surface extent that is in contact with the front side of the heat-insulating housing when the sealing profile performs its sealing function and the surface extent of the dislodgable location of the sealing profile does not move out of contact with the front side of the heat-insulating housing during an expansion of the flexible swelling element from its stand by volume to its completed expansion volume until the flexible swelling element has reached its completed volume.

* * * * *